United States Patent [19]

Luisada et al.

[11] 3,952,295

[45] Apr. 20, 1976

[54] ALARM SYSTEM FOR CARGO BOX

[75] Inventors: August G. Luisada, Waymart, Pa.; Leonard P. Frieder, Sr., deceased, late of Clarks Green, Pa.; by Leonard P. Frieder, Jr., executor, Waverly, Pa.

[73] Assignee: Gentex Corporation, Carbondale, Pa.

[22] Filed: Aug. 2, 1974

[21] Appl. No.: 494,086

Related U.S. Application Data

[62] Division of Ser. No. 286,462, Sept. 5, 1972, Pat. No. 3,853,238.

[52] U.S. Cl. ..... 340/273; 340/274 R

[51] Int. Cl.[2] ..... G08B 13/12

[58] Field of Search ..... 340/274 R, 274 C, 273

[56] References Cited

UNITED STATES PATENTS

| | | | |
|---|---|---|---|
| 181,078 | 8/1876 | Larned | 340/273 |
| 3,594,770 | 7/1971 | Ham et al. | 340/273 |
| 3,634,845 | 1/1972 | Colman | 340/273 |
| 3,763,795 | 10/1973 | Wetz, Jr. | 340/273 |
| 3,772,674 | 11/1973 | Jackson | 340/273 |

*Primary Examiner*—Glen R. Swann, III

*Attorney, Agent, or Firm*—Shenier & O'Connor

[57] ABSTRACT

An alarm system for a cargo box made up of a plurality of panels adapted to be assembled to form the box, in which each panel is provided with a conductor distributed throughout the panel, and in which the conductors of adjacent panels are connected in series when the box is assembled to complete a circuit including an alarm device when a lock is operated. The arrangement is such that the alarm system is silent so long as the conductors complete the circuit. When the circuit is broken with the lock still locked, the alarm system gives a signal indicating that an unauthorized person is attempting either to open the container or to break through a panel thereof in an effort to gain access to the contents.

7 Claims, 3 Drawing Figures

Fig 1
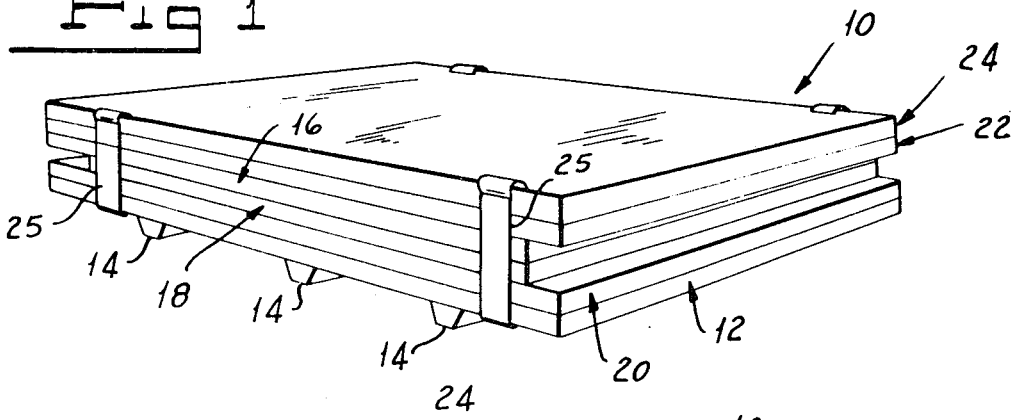
Fig 2
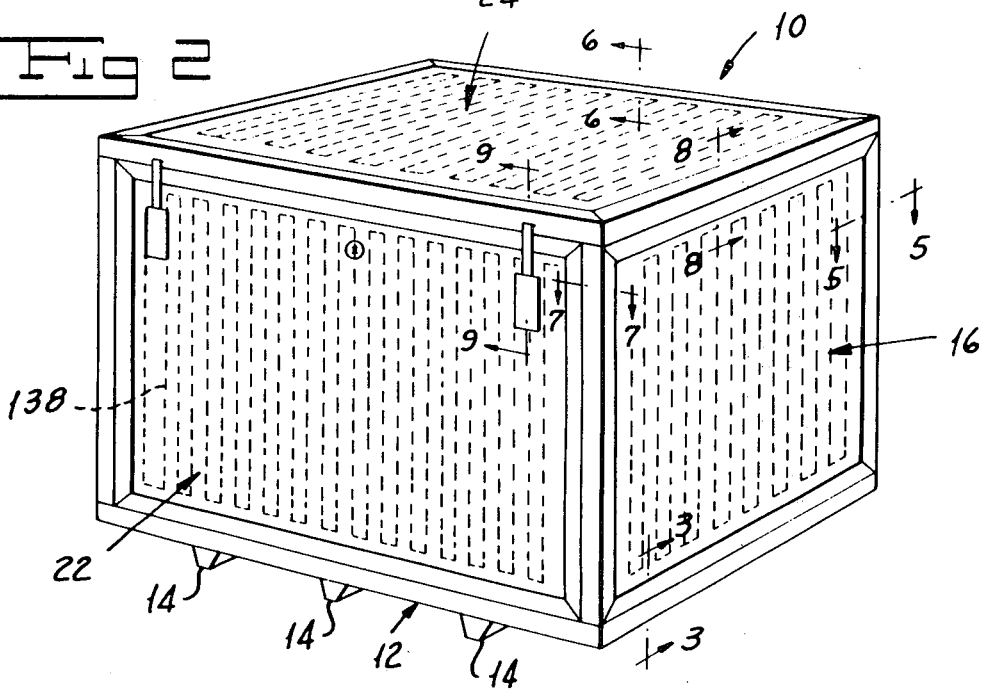
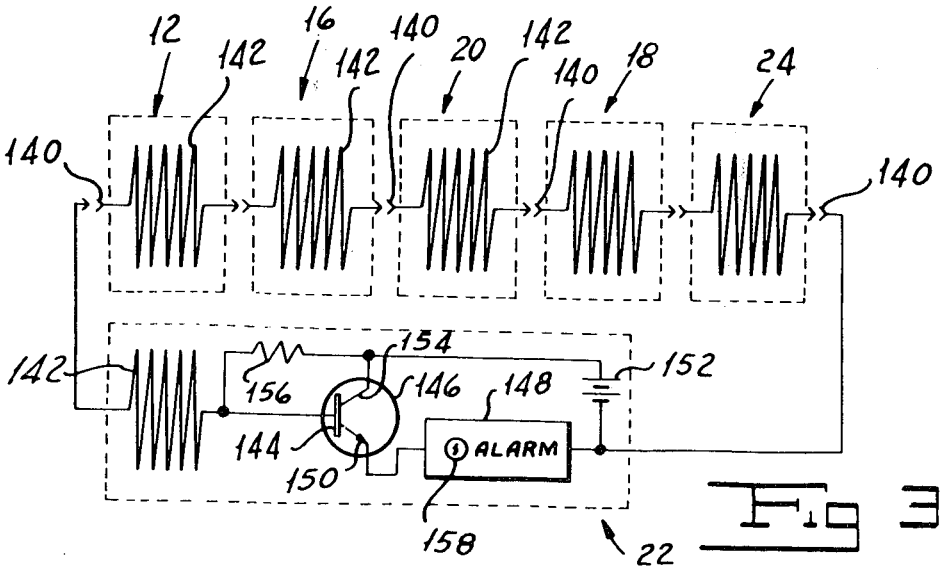
Fig 3

ALARM SYSTEM FOR CARGO BOX

This is a division of application Ser. No. 286,462 filed Sept. 5, 1972 now U.S. Pat. No. 3,853,238.

BACKGROUND OF THE INVENTION

There are known in the prior art boxes or containers which are especially adapted to receive articles of cargo for shipment by aircraft.

Examples of containers of this type are shown, for example, in Luisada and Frieder Pat. No. 3,563,403 for a Cargo Box, Luisada Pat. No. 3,575,312 for a Refrigerated Cargo Box, Luisada Pat. No. 3,655,087 for a Lightweight Knockdown Container, and in our copending Application Ser. No. 286,462, filed Sept. 5, 1972, for a Smooth Operating Cargo Box, now U.S. Pat. No. 3,853,238. While boxes of this type may be provided with locks or the like in an effort to prevent unauthorized entry into the box, the possibility exists that a dishonest person may attempt to enter the box either by breaking the lock or by entering the box through one of the panels thereof. We have invented an alarm system for a cargo box for signalling an attempt by an unauthorized person to enter the box. Our system greatly adds to the security of the contents of the box. It is relatively simple in construction and operation for the result achieved thereby. It signals not only in response to a forced entry into the box by separating the panels but also a forced entry by cutting through one of the panels making up the box.

SUMMARY OF THE INVENTION

One object of our invention is to provide an alarm system for a cargo box.

Another object of our invention is to provide an alarm system for a cargo box which signals unauthorized entry into the box through one of the panels making up the box.

A further object of our invention is to provide an alarm system for a cargo box which greatly adds to the security of the goods stored within the box.

Yet another object of our invention is to provide an alarm system for a cargo box which is relatively simple in construction and in operation.

Other and further objects of our invention will appear from the following description.

In general our invention contemplates the provision of an alarm system for a cargo box made up of a plurality of panels adapted detachably to be assembled to form the box in which a continuous length of conductor is distributed throughout each of the panels and in which the respective conductors are connected in series as the panels are erected to enable an alarm in such a way that the alarm provides its signal when the circuit formed by the conductors is broken.

BRIEF DESCRIPTION OF THE DRAWINGS

In the accompanying drawings which form part of the instant specification and which are to be read in conjunction therewith and in which like reference numerals are used to indicate like parts in the various views:

FIG. 1 is a perspective view of our smooth operating cargo box with the panels thereof stacked for shipment.

FIG. 2 is a perspective view of our smooth operating cargo box in assembled condition.

FIG. 3 is a schematic view of one form of alarm circuit which may be used with our smooth operating cargo box.

DESCRIPTION OF THE PREFERRED EMBODIMENT

Referring now to FIGS. 1 and 2 of the drawings, our smooth operating cargo box, indicated generally by the reference character 10, includes a base, indicated by the reference character 12, which may, for example, be provided with skids 14 so arranged as to permit a fork lift to raise the container. Container 10 includes sides, indicated generally by the respective reference characters 16 and 18, a back, indicated generally by the reference character 20, a front, indicated generally by the reference character 22 and a top, indicated generally by the reference character 24. In the condition of the box illustrated in FIG. 1 the various panels have been separated and stacked on top of the base 12. If desired, any suitable means such as straps 25 or the like may be employed to hold the stacked panels together.

We provide our cargo box with means for sounding an alarm when an unauthorized person attempts either to open the container or to gain access thereto by breaking through one of the panels. In the course of manufacturing each of the panels of the container, we distribute a conductor 138 therethrough in such a way that the continuity thereof will be broken in the event that a person cuts away or breaks a portion of the panel. When the panels are assembled respective connectors 140 engage to provide a plurality of series connected resistors 142 formed by the conductors 138 in the respective panels. We connect one terminal of the resistor 142 in the front panel 22, for example, to the base 144 of a transistor 146. We connect an alarm device 148 of any suitable type between the emitter 150 of transistor 146 and the female connector portion of the panel 22. A battery 152 in the circuit of the collector 154 of transistor 146 with the alarm 148 provides a source of power. We connect a resistor 156 having a resistance value which is relatively high as compared with the aggregate of resistors 142 between the collector and base of transistor 146. A key-operated switch 158 is adapted to be actuated to render the alarm system operative after the box has been assembled. Normally the aggregate resistance of resistors 142 acts as a shunt to prevent sufficient voltage from being applied to base 144 to render the transistor conductive. However, if the shunt circuit is broken at any point the transistor is rendered conductive and the alarm 148 is activated. It will readily be appreciated that the intended consignee of the box 10 is provided with a key for operating switch 158 to disable the alarm system before he opens the box.

In use of the cargo box 10 the various panels of the stack illustrated in FIG. 1 are connected in the manner illustrated in FIG. 2 to erect the box and the proper cargo is stowed therein. After the box has been erected and the cargo stowed therein and the box closed, switch 158 is actuated to render the alarm system operative. If an unauthorized person opens the box, one of the couplings 140 will be disengaged and the alarm will sound. If an attempt is made to enter the box by breaking through one of the panels the conductor 138 of that panel will be broken and the alarm will sound.

Upon arrival at its intended destination, the receiver first opens switch 158 to de-activate the alarm. He next disassembles the box by reversing the procedure described above. The panels of the container can then be stacked flat as shown in FIG. 1 for storage or for shipment back to the point of origin.

It will be seen that we have accomplished the objects of our invention. We have provided an alarm system for a cargo box for signalling an unauthorized entry into the box. Our system signals not only a separation of the panels making up the box but an attempt to enter the box by penetrating one of the panels. Our system greatly adds to the security of the contents of the box. It is relatively simple for the result achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A smooth operating cargo box including in combination, a base, side panels, a back panel, a front panel and a top panel, first interengageable means running along the side edges of said base and along the bottom edges of the side panels for connecting said side panels to said base, second interengageable means along the bottom and side edges of the back panel and along the back edge of the base and back edges of the side panels and responsive to sliding movement of the back panel from the inside toward the outside of said box in a direction perpendicular to the plane of the back panel for connecting the back panel to the base and side panels, third interengageable means comprising outwardly opening side hooks running along the front edges of the side panels and inwardly opening end hooks running along the side edges of the front panel responsive to pivotal movement of the front panel around its bottom edge in a direction from outside toward the inside of said box for connecting said front panel to said base and interengaging the front panel with the side panels, fourth interengageable means comprising outwardly opening side hooks running along the upper edges of the side panels and inwardly opening end hooks running along the side edges of the top panel and an inwardly opening side hook running along the rear edge of said top panel and an outwardly opening end hook running along the top edge of the back panel responsive to sliding movement of said top panel in the direction of the plane thereof from back to front of said box for connecting said top panel to said back and side panels, a latch for holding the front edge of the top panel down on the top edge of the front panel and means for producing a signal in response to unauthorized entry into said box.

2. a cargo box as in claim 1 in which said alarm means comprises an electrical conductor distributed throughout said panels.

3. A smooth operating cargo box including in combination, a base, side panels, a back panel, a front panel and a top panel, first interengageable means running along the side edges of said base and along the bottom edges of the side panels for connecting said side panels to said base, second interengageable means along the bottom and side edges of the back panel and along the back edge of the base and back edges of the side panels and responsive to sliding movement of the back panel from the inside toward the outside of said box in a direction perpendicular to the plane of the back panel for connecting the back panel to the base and side panels, third interengageable means along the bottom and side edges of the front panel and along the front of the base and front edges of the side panels responsive to pivotal movement of the front panel around its bottom edge in a direction from outside toward the inside of said box for connecting said front panel to said base and interengaging the front panel with the side panels, fourth interengageable means along the back and side edges of the top panel and along the top edge of the back panel and top edges of the side panels responsive to sliding movement of said top panel in the direction of the plane thereof from back to front of said box for connecting said top panel to said back and side panels, and means for producing a signal in response to unauthorized entry into said box.

4. A cargo box as in claim 3 in which said alarm means comprises an electrical conductor distributed throughout said panels.

5. A self-contained manually assemblable and disassemblable cargo box including in combination, a base, a pair of side panels, a back panel, a front panel and a top panel, first manually operable interengageable means running along the side edges of said base and along the bottom edges of the side panels for manually detachably connecting said side panels to said base, second manually operable interengageable means along the bottom and side edges of the back panel and along the back edge of the base and back edges of the side panels for manually detachably connecting the back panel to the base and side panels, third manually operable interengageable means running along the front edges of the side panels and along the side edges of the front panel for manually detachably connecting said front panel to said base and side panels, fourth manually operable interengageable means along the upper edges of the side panels and along the side edges of the top panel for manually detachably connecting the side panels to the top panel, fifth manually operable interengageable means along the rear edge of the top panel and the top edge of the back panel for manually detachably connecting said top panel to said back panel, respective continuous conductors distributed throghout said panels, alarm means comprising a source of power carried by one of said panels, a plurality of releasable electrical couplings responsive to operation of said interengageable means for interconnecting said conductors and for connecting said conductors in operative relationship with said alarm means.

6. A cargo box as in claim 5 including a lockoperated switch for activating said alarm means.

7. A self-contained cargo box as in claim 5 in which said alarm means an alarm device connected in parallel with said source and in which said interconnecting means connect said conductors in series with each other.

* * * * *